US007707699B2

(12) United States Patent
Belforte et al.

(10) Patent No.: US 7,707,699 B2
(45) Date of Patent: May 4, 2010

(54) HIGH-PERFORMANCE DEVICE FOR AIR INTERLACING OF A YARN AND CORRESPONDING METHOD

(75) Inventors: Guido Belforte, Turin (IT); Alexandre Ivanov, Turin (IT); Stefano Mauro, Turin (IT); Francantonio Testore, Turin (IT)

(73) Assignee: Sinterama S.p.A., Sandigliano (BI) (IT)

( * ) Notice: Subject to any disclaimer, the term of this patent is extended or adjusted under 35 U.S.C. 154(b) by 649 days.

(21) Appl. No.: 11/664,977

(22) PCT Filed: Oct. 10, 2005

(86) PCT No.: PCT/IT2005/000590

§ 371 (c)(1),
(2), (4) Date: Apr. 9, 2007

(87) PCT Pub. No.: WO2006/040789

PCT Pub. Date: Apr. 20, 2006

(65) Prior Publication Data

US 2009/0007403 A1 Jan. 8, 2009

(30) Foreign Application Priority Data

Oct. 12, 2004 (IT) ..... BI04A0004

(51) Int. Cl.
*D02J 1/08* (2006.01)

(52) U.S. Cl. ..... 28/274; 28/275

(58) Field of Classification Search ..... 28/274, 28/275, 271, 273, 276, 272, 254, 283; 57/350, 57/908, 333, 289

See application file for complete search history.

(56) References Cited

U.S. PATENT DOCUMENTS

| | | | | |
|---|---|---|---|---|
| 3,026,597 | A | 3/1962 | Swaney et al. | |
| 3,262,179 | A * | 7/1966 | Sparling | 28/274 |
| 3,537,248 | A | 11/1970 | Berg et al. | |
| 3,730,413 | A * | 5/1973 | McDermott et al. | 28/272 |
| 4,070,815 | A | 1/1978 | Negishi et al. | |
| 4,355,445 | A * | 10/1982 | Matsumoto et al. | 28/274 |
| 4,644,620 | A * | 2/1987 | Maeda | 28/220 |
| 5,010,631 | A | 4/1991 | Ritter | |

(Continued)

FOREIGN PATENT DOCUMENTS

EP 0 121 010 A 10/1984

(Continued)

*Primary Examiner*—Amy B Vanatta
(74) *Attorney, Agent, or Firm*—Banner & Witcoff, Ltd.

(57) ABSTRACT

A device for air interlacing (10) of a yarn (Y), comprising an interlacing chamber (24), a first entrance channel (22) for receiving the yarn (Y) at the device (10) entrance and feeding it to the interlacing chamber (24), and a second exit channel (23) for receiving the yarn from the interlacing chamber (24) and releasing it at the device exit, in which the interlacing chamber (24) is delimited by a first emitting wall (24*a*) bearing a nozzle (26) for the emission of a continuous jet of compressed air (31), and a second deflecting wall (24*b*), opposite the first wall (24*a*), suitable for receiving and deflecting the jet of compressed air (31) emitted by the nozzle (26) and intersecting the yarn to be interlaced, and in which the second deflecting wall (24*b*) is concave in shape both on a transversal plane and on a longitudinal plane with respect to the feeding path (11) of the yarn (Y) through the device.

24 Claims, 4 Drawing Sheets

U.S. PATENT DOCUMENTS

| | | | | | |
|---|---|---|---|---|---|
| 5,481,787 | A * | 1/1996 | Sano et al. | 28/276 | |
| 6,134,759 | A * | 10/2000 | Saijo et al. | 28/274 | |
| 6,543,105 | B1 * | 4/2003 | Kemp et al. | 28/274 | |
| 7,568,266 | B2 * | 8/2009 | Simmen | 28/275 | |

FOREIGN PATENT DOCUMENTS

| | | | |
|---|---|---|---|
| EP | 0 371 914 | A | 6/1990 |
| EP | 1 207 226 | A | 5/2002 |

* cited by examiner

HIGH-PERFORMANCE DEVICE FOR AIR INTERLACING OF A YARN AND CORRESPONDING METHOD

This is a U.S. National Phase Application Under 35 USC 371 and applicant herewith claims the benefit of priority of PCT/IT2005/000590 filed on Oct. 12, 2005, which was published Under PCT Article 21(2) in English, and of Application No. BI2004A000004 filed in Italy on Oct. 12, 2004. The contents of the applications are incorporated by reference herein.

Technical Field

This invention relates in general to a device for the interlacing of a yarn, and more precisely to an air type interlacing device, i.e. one suitable for producing the effect of interlacing of a yarn, as it traverses the device, by intersecting this yarn with a continuous jet of compressed air. The invention also relates to a corresponding method for air interlacing of a yarn.

Background Art

As is known, in textile technology, the interlacing operation may be considered to be a fundamental part of a more general process, often called texturizing, the purpose of which is to have a starting textile element, essentially consisting of a synthetic thread made up of numerous filaments, acquire properties, outer appearance, and suitability for subsequent machining work that are typical of a conventional yarn or warp thread.

Accordingly, in the texturizing process, the starting multifilament synthetic thread is appropriately treated and transformed in such a way as to assume characteristics of stability, resistance, volume and softness that are comparable with those of a traditional yarn, made for instance from natural fibres, thus making it possible, inter alia, to machine the yarn during the successive steps envisaged in the textile cycle, among which—by way of example only—weaving.

In this context, the interlacing operation consists specifically in treating the starting composite synthetic yarn which, as it is composed of a plurality of filaments arranged according to a fairly simple, orderly structure, is substantially instable and lacking in cohesion, in such a way as to cause a telescoping and a mixing of this filamentary structure, with the resulting creation of bonds between the filaments and the end result of conferring stability, compactness and resistance to the interlaced yarn thus produced which, thanks to these characteristics becomes suitable for the subsequent textile machining work.

In particular, an interlaced yarn produced with the current techniques has typically, along its length or longitudinal extension, a complex filamentary structure, characterized by an alternation of zones having a finer section with zones of a thicker section, in which the zones of finer section, also called knots or zones of cohesion, correspond to portions of the yarn in which there is a concentration of the bonds between the filaments produced by the interlacing operation, and in which the zones of thicker section correspond to portions of yarn where there are either none of these bonds or where they are sparse, and where therefore there is less binding among the filaments.

The number of these knots, per unit of length of the interlaced yarn produced, is often considered as a highly significant parameter, offering a quantitative definition of the quality and yield of the interlacing operation.

An important interlacing technique, used widely throughout the industry, makes use of a jet of compressed air, emitted inside a substantially enclosed space or volume, delimited by walls, which is associated with a channel-shaped guide, in turn provided for receiving in the longitudinal direction a composite yarn to be interlaced, made up of various filaments.

In this technique, the jet of compressed air creates around the yarn, while it continuously advances along this guide channel, a turbulent flow that interacts with the yarn and causes an entangling of its filaments, thus creating a multitude of bonds between these, with the result of conferring robustness and stability on the interlaced yarn thus obtained as it is released at the outlet of the guide channel.

The jet of compressed air is emitted constantly by a nozzle which opens upon the closed space around the yarn as it advances along the guide channel, so as to create and feed continuously the turbulent flow needed to produce the interlacing between the filaments of the yarn.

The air then departs along the guide channel from the enclosed space arranged about the yarn where the turbulent flow is created, before being dispersed into the external environment.

The compressed air needed for constantly feeding the corresponding jet is produced continuously by a suitable compression station.

In practice, the industrial machinery and systems for the production of texturized and/or interlaced yarns comprise a very large number of interlacing units, so as to simultaneously produce in an efficient and economically sustainable way a large number of interlaced yarns, in the massive quantities required by the market.

Therefore, in relation to these machines and systems, the compression stations must be constructed of appropriate dimensions corresponding to this large number of interlacing units, in order to be able to produce under steady conditions a considerable quantity of compressed air, such as the various interlacing units globally require.

Correspondingly the consumption under steady conditions of electric power by these compression stations to produce the compressed air needed by the interlacing units, is, on the whole, also high and very significant from the viewpoint of interlaced yarn manufacturing costs.

From what has been said, it will be obvious how it is essential and important, if we are to reduce both the costs of installing and operating the compression stations, and also the incidence of the power quota on production of the interlaced yarns, to try to obtain an interlaced yarn with the minimum consumption of compressed air, or better, to attempt to have a consumption of compressed air that is as low as possible, for a given quantity of interlaced yarn produced and for a like interlacing quality.

For it is clear that the immediate effect of a reduction in the consumption of compressed air, in whatever way it is obtained, is an improvement in the general performance of the interlacing operation, with undoubted advantages both in technical terms and economic terms.

The state of the art features numerous solutions and improvements concerning devices for air interlacing of yarns; similarly the market offers a broad range of models and types of these interlacing devices, produced by some of the leading manufacturers.

For example, one device for air interlacing of a yarn is known from the U.S. Pat. No. 6,438,812 B1 which has an interlacing duct, suitable for longitudinally receiving a synthetic yarn to be interlaced, in turn comprising a first entrance segment, a second central segment, and a third exit segment, in which the second central segment, placed between the first and the third segments, has a transverse section that is greater than that of the first and third segments, and in which the internal volume of the second segment is closed off by a first concave wall bearing a nozzle for emission of a jet of compressed air and by a second flat wall, opposite the first concave wall and suitable for receiving and deflecting the jet of compressed air emitted by the nozzle and intersecting the yarn to be interlaced.

A similar configuration for a central turbulence chamber and associated yarn entrance and exit channels in a yarn air interlacing device is described by the U.S. Pat. No. 4,644,620.

Again numerous other types and solutions for yarn air interlacing devices have been put forward by the known art. For instance, in each of the solutions proposed by the documents U.S. Pat. Nos. 5,841,787, 5,081,631, 4,011,640 and EP 1 207 226 A1, a device for air interlacing of a yarn is provided with an interlacing duct, suitable for receiving the yarn to be interlaced, of constant section, which can be triangular, or circular, or oval, etc. in the longitudinal direction along the path followed by the yarn through the device, with a nozzle for emission of the jet of compressed air placed in correspondence with a central zone of the constant section channel.

The document EP 0 564 400 A1 in turn describes an interlacing device that has a variable section interlacing duct defined by convex and diverging surfaces towards the yarn entrance and exit zones, with the nozzle for emission of the jet of compressed air arranged local to the lesser section of the channel.

Finally the documents U.S. Pat. Nos. 6,564,438 B1, 6,112,386 and EP 1 207 226 A1 provide for the use of various nozzles for conveying and emitting corresponding jets of compressed air in the zone of turbulence around the yarn, and also refer to special shapes and sections for these nozzles.

DISCLOSURE OF INVENTION

In view of the current state of the sector art, and especially of that mentioned above, the Applicant noted that there is still significant room for improvement in air interlacing devices for yarns, and more concretely posed the problem of producing an air interlacing device capable of going further and significantly improving the performance of the known devices, especially in terms of knots produced, and/or of consumption of compressed air, at the same time maintaining unaltered, or even possibly improving, the quality of the interlaced yarn produced.

In particular, at the basis of the invention, it was noted by the Applicant how certain details and characteristics, often neglected or not sufficiently studied by the known art, such as that cited previously, are on the contrary very important for the purpose of obtaining best results in terms of quality and performance of the yarn interlacing operation.

In a special way, including with the support of in-depth theoretical simulations and experimental tests, the Applicant realized how in general the configuration of the interlacing duct, and more specifically the shape, dimensions and arrangement of the walls that delimit, along this duct, the chamber that receives the jet of compressed air and inside which the turbulent flow and the whirls responsible for interlacing of the yarn are generated, constitute fundamental points and parameters, to which much attention must therefore be dedicated, when wishing to optimize the characteristics of the turbulent flow, limit the consumption of compressed air, and generally, enhance the performance of the interlacing device.

In a first aspect, corresponding to the main independent claim, the invention relates to a device for air interlacing of a yarn which comprises an interlacing duct along which the yard passes and is guided through the device, in which the interlacing duct has an interlacing chamber which is delimited by a first emitting wall bearing a nozzle for the emission of a jet of compressed air inside the interlacing chamber, and by a second deflecting wall, opposite the first wall, suitable for receiving and deflecting the jet of compressed air emitted by the nozzle and intersecting the yarn to be interlaced, and in which the device is characterized in that the second wall has a concave shape.

In addition, in a second aspect complementary to the first, the invention relates to a method for air interlacing of a yarn comprising the following steps:

feeding the yarn along a respective feeding path, intersecting with a jet of compressed air the yarn as it advances, and deflecting the jet of air intersecting the yarn by means of a first surface arranged on a side, with respect to said yarn, opposite that of emission of the jet of compressed air and having a concave shape both on the longitudinal plane and on a transverse plane with respect to the yarn feeding path, in which the first concave surface is associated with a second surface arranged, with respect to the yarn, on the side of emission of the jet of compressed air and is suitable for receiving the air deflected by the first concave surface so as to define with the latter-named an interlacing chamber around the yarn as it advances.

In another aspect of the invention, the concave wall of the interlacing chamber that receives and deflects the jet of compressed air is specifically defined by a semi-spherical surface.

Further, in yet another aspect of the invention, a resonance chamber is associated with the interlacing chamber and opens on the relative concave wall in order to increase the efficacy of the air whirls inside the interlacing chamber.

BRIEF DESCRIPTION OF DRAWINGS

These and other characteristics, aspects and objects of the invention will appear more clearly from the following description of one embodiment, provided by way of a non-restrictive example, with reference to the figures of the accompanying drawings, in which.

BEST MODE FOR CARRYING OUT THE INTERLACING DEVICE OF THE INVENTION

Figure 1:
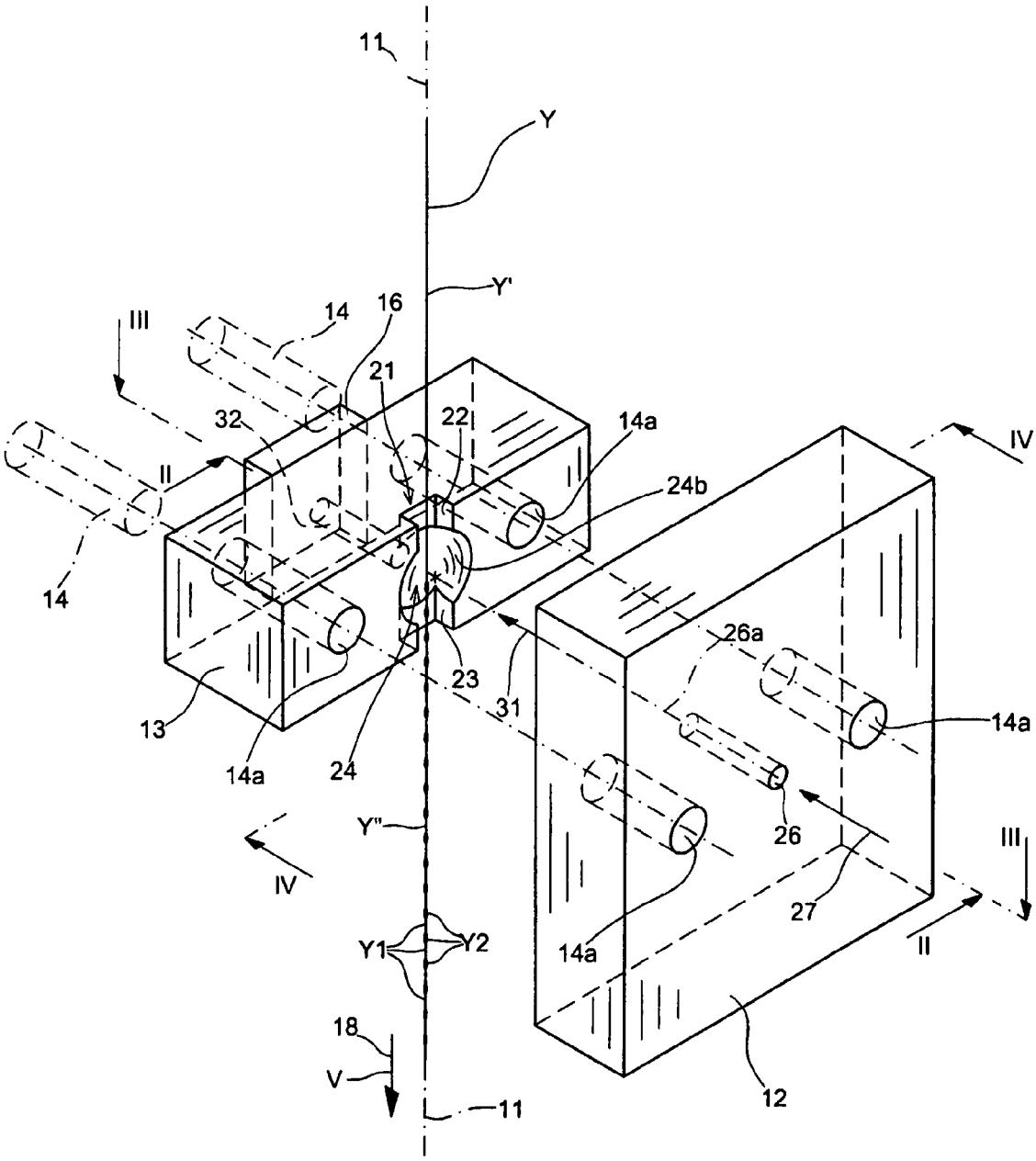
FIG. 1 is a perspective view of a device for the interlacing of a yarn according to this invention, represented in enlarged form.
Figure 4:
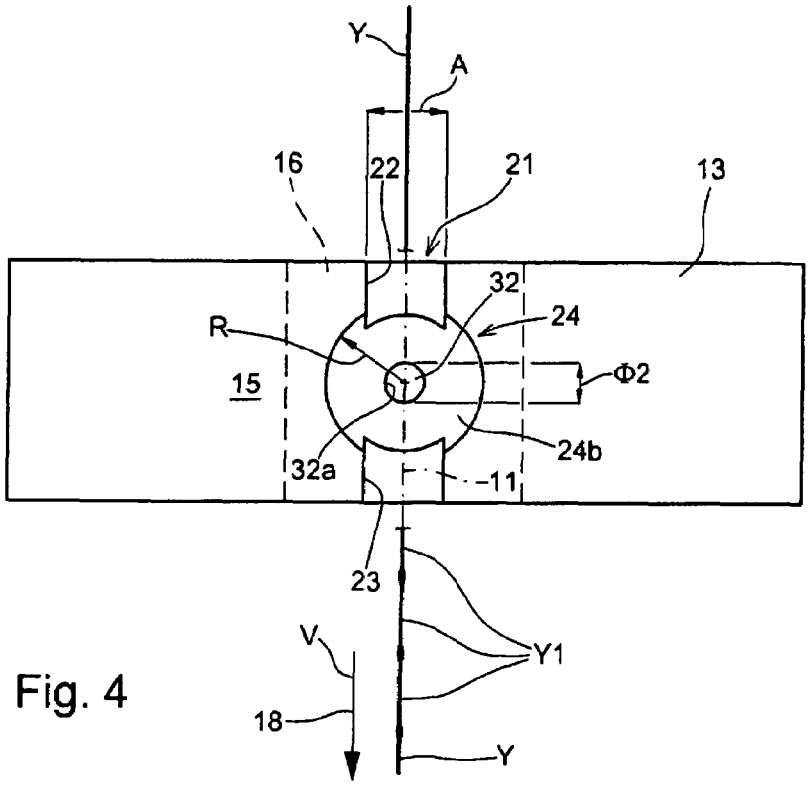
FIG. 4 is a frontal view, along the plane corresponding to the line IV-IV, of the interlacing device of FIG. 1.

With reference to FIGS. 1 and 4, a device for air interlacing of a yarn Y, produced according to this invention, is generically designated with the numeral 10, and is for example integrated in a more complex texturizing unit, of known type and therefore only referred to here only summarily and not represented in the drawings.

In FIG. 1, the interlacing device 10 is represented in broken-down or exploded form and defines a longitudinal axis 11, along which the yarn Y, as it advances at a given feed speed V in the direction indicated by an arrow 18, accedes to and completely traverses the device 10, where it is interlaced.

Preferably the yarn Y, which is produced in a known way by a production unit operating before the device 10, is of synthetic type and is formed by numerous filaments.

The portion of yarn Y, coming from a previous station in the texturizing unit and which accedes to the device 10 in which it undergoes the interlacing operation, is indicated with Y' and has a non-interlaced structure, i.e. it is essentially without cohesion, in which the filaments are disposed and oriented in a simple, fairly regular way.

The portion of yarn Y, which has already undergone the interlacing operation and which is released from the device 10 towards other stations of the texturizing unit, is indicated with Y", and has instead its filaments in a complex and interlaced structure.

In particular the portion Y", coming out of the device 10, is characterized along its length by a succession of fine zones, or knots, indicated with Y1, in which the bonds between the filaments made by the device 10 are concentrated, and thick zones, indicated with Y2, in which these bonds have not formed, and are therefore practically missing, or have been formed to a lesser extent.

The knots Y1 are reciprocally spaced out along the yarn Y according to a pitch which, as a result of the interlacing operation produced by the device 10, is substantially constant.

The structure of the interlacing device 10 is, according to a known concept, of an opening type, and is formed essentially by two bodies or blocks or main parts, respectively a first body 12 and a second body 13, suitable for being opened and closed with respect to one another, in particular to permit introduction of the yarn Y through the device 10, and also access to the inside of the device 10, for instance for maintenance and cleaning purposes.

The two bodies 12 and 13 can be exactly mounted and fastened one on top of the other in correspondence with and along a common, flat contact surface 15, thanks to known type fastening and reference means.

For clarity's sake, these known fastening means are depicted in FIG. 1 with two plugs 14, represented by the dot and dash line and suitable for cooperating with corresponding holes 14*a* formed on the bodies 12 and 13.

Figure 2:
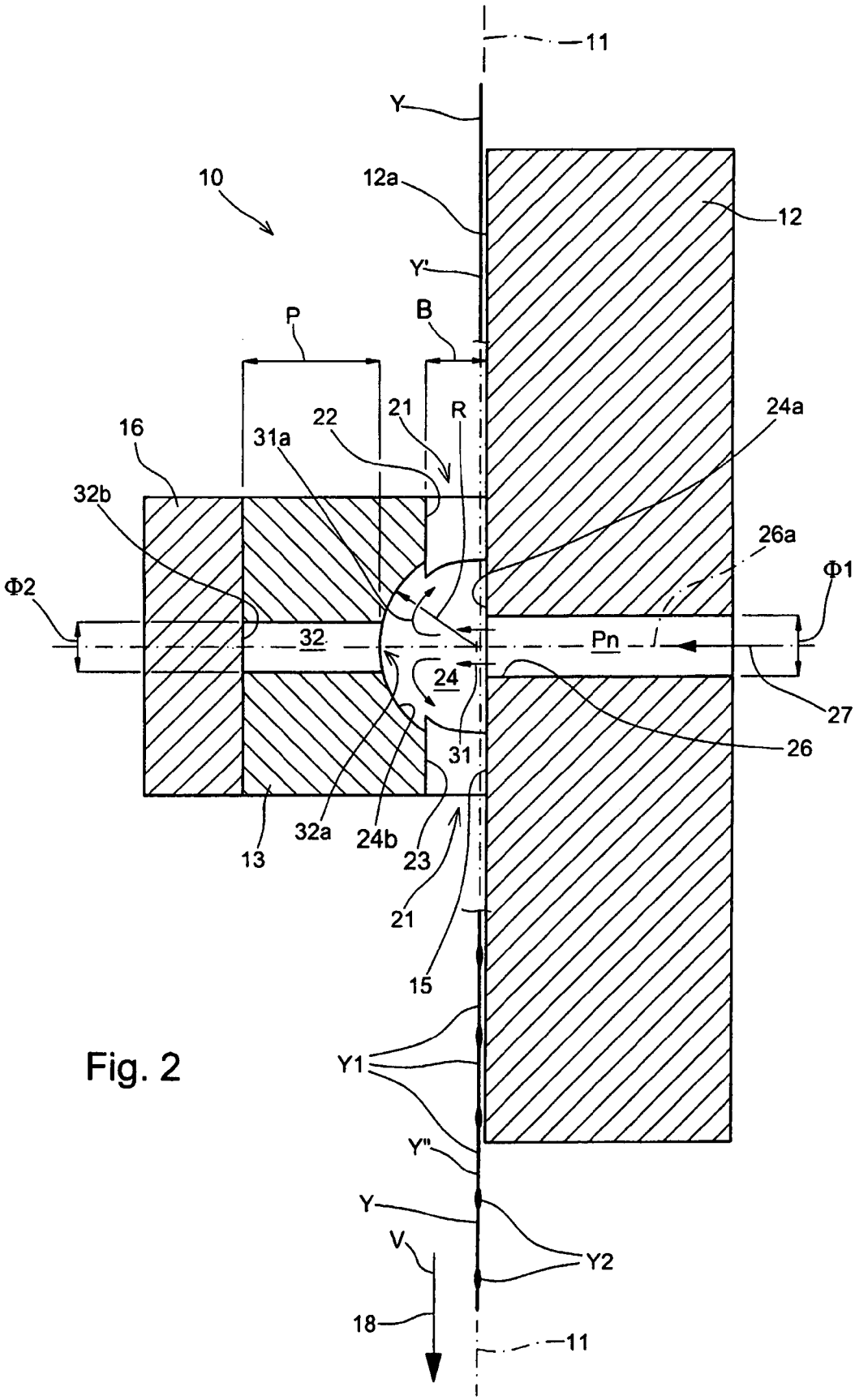
FIG. 2 is a first section view, along the plane corresponding to the line II-II, of the interlacing device of the invention of FIG. 1, shown in its assembled form.
Figure 3:
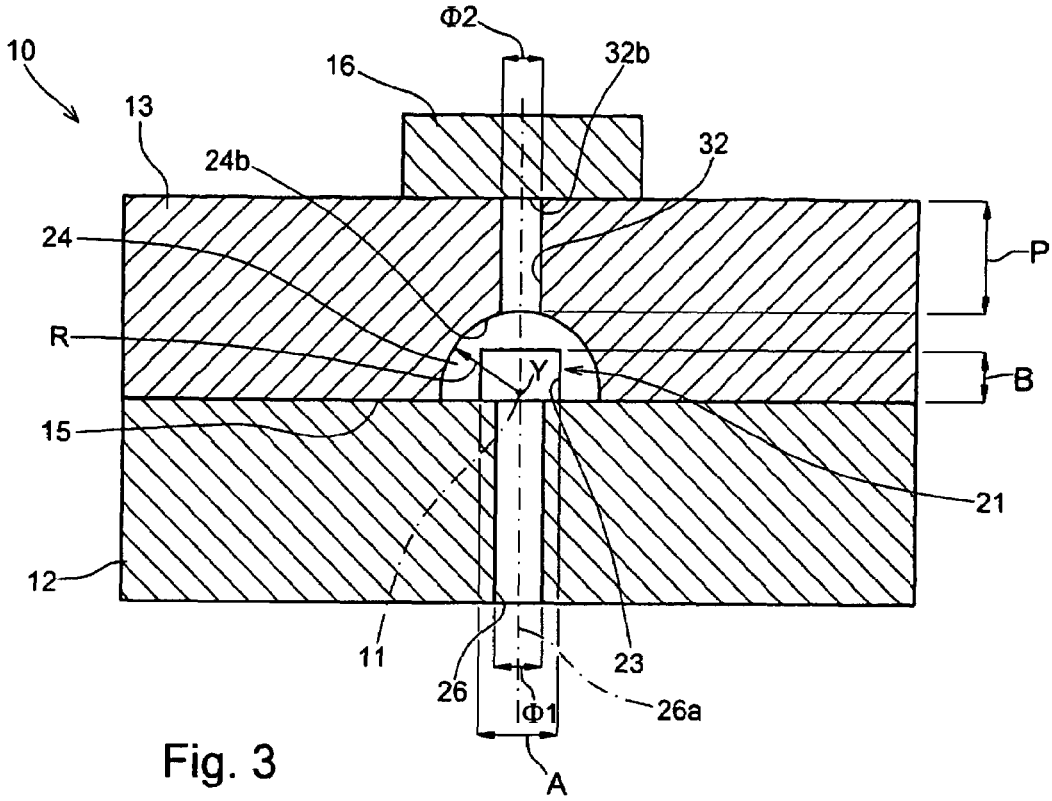
FIG. 3 is a second section view, along the plane corresponding to the line III-III, of the interlacing device of FIG. 1.

The two bodies 12 and 13, once assembled as shown in FIGS. 2-4, define, along the common flat contact surface 15, an interlacing duct 21 for the yarn Y, extending along the axis 11, and formed by a first entrance channel 22, a second exit channel 23, and an intermediate interlacing chamber 24, also called turbulence chamber, arranged between the entrance channel 22 and the exit channel 23.

The first entrance channel 22 and the second exit channel 23 are provided respectively for receiving, at the entrance to the device 10, the portion Y', to be interlaced, of the yarn Y, and for releasing, at the exit of the device 10, the portion Y" of the yarn Y, after it has been interlaced.

In addition, as is clearly shown in the drawings and in particular in FIG. 3, the first entrance channel 22 and the second exit channel 23 preferably have a respective transverse section, on the plane normal to the axis 11 i.e. to the feeding direction of the yarn Y along the duct 21, which is less than the transverse section of the intermediate interlacing chamber 24, again on this plane.

The interlacing chamber 24 is defined and delimited, along the interlacing duct 21, by two opposite walls, respectively 24*a* and 24*b*, also called emitting wall and deflecting wall, the former of which made in the first body 12 and the second in the second body 13.

A nozzle 26, for the emission of a continuous jet of compressed air inside the volume defined by the interlacing chamber 24, is made in the first body 12 and opens onto the interlacing chamber 24, along the relative wall 24*a*.

The compressed air that feeds the nozzle 26 at a nominal pressure Pn to generate the corresponding jet of compressed air is produced and supplied continuously, as indicated by an arrow 27, by means of a known type of compressed air plant, not depicted in any of the drawings, which is adapted to be suitably controlled in order to maintain the compressed air that feeds the nozzle 26 at the nominal pressure Pn in time.

On this subject it should be added that, in the context of this invention, the term air is to be understood as also indicating other fluids, liquid or gaseous, capable in any event of creating phenomena of turbulence around the yarn, that are suitable for interlacing it.

The nozzle 26 is defined by a cylindrical hole, of diameter Ø1, substantially oriented along a respective axis 26*a* in a direction perpendicular to the axis 11 of the device 10, and is also disposed in a central and symmetrical position with respect to the internal volume of the interlacing chamber 24.

According to a key and essential characteristic of this invention, the wall 24*b*, which delimits the interlacing chamber 24 and is arranged, in front of the nozzle 26 for receiving and deflecting the corresponding jet of compressed air in order to create the turbulence effect inside the same chamber 24, as better explained in the following, has a special concave shape which is defined by a concave surface on both the transverse and longitudinal planes with respect to the axis 11, i.e. to yarn Y feeding path through the device 10.

In addition, the wall 24*a* of the turbulence chamber 24, opposite the concave wall 24*b* and bearing the nozzle 26, in turn has a flat shape defined by a flat surface that corresponds to the contact plane 15 between the two bodies 12 and 13, and is suitable for enclosing the concave surface of the wall 24*b*.

Accordingly, in this configuration, the interlacing chamber 24 is completely embedded in the second body 13.

The entrance and exit channels, respectively 22 and 23, are in turn carved out completely in the second body 13, in such a way as to join, at opposite ends, with the concave surface of the wall 24*b*, thus leaving unaltered the flat surface of the first body 12, along the plane of contact 15.

Furthermore the body 12 extends, in the direction of the axis 11 and externally with respect to the entrance and exit channels 22 and 23, along the same plane of contact 15 as defines the flat wall 24*a* of the interlacing chamber 24, in such a way as to define a flat guide wall 12*a*, for guiding and supporting the yarn Y, as it traverses the device 10, as will be described better below.

Preferably, the concave shape of the wall 24*b* is produced according to a semi-spherical surface, defined by a radius R, wherein this semi-spherical surface is enclosed along the perimeter by the flat surface of the wall 24*a*, so as to form the interlacing chamber 24, and in which the nozzle 26 opens on the said interlacing chamber 24 in correspondence with the centre of the sphere of radius R defining this semi-spherical surface The entrance and exit channels 22 and 23, made in the body 13, have in turn, a constant transverse section along the axis 11, in particular rectangular shape, defined by a width A and a height B, measured respectively along and starting from the contact plane 15 between the two bodies 12 and 13.

The interlacing device 10 also includes a compartment 32, also called resonance chamber, which is associated with the interlacing chamber 24 and which opens upon the bottom of the concave wall 24*b*, in correspondence with the zone of maximum depth of said concave wall 24*b*, i.e. of maximum distance from the flat wall 24*a*.

In detail, the resonance chamber 32 extends, through the body 13 and in a directly substantially in line with the axis 26*a* of the nozzle 26, between an opening 32*a* made in the concave wall 24*b* in an area in front of the nozzle 26 and which accordingly puts the volume of the resonance chamber 32 in communication with the volume of the interlacing chamber 24, and an opposite closed bottom 32*b* of the resonance chamber 32, which is made for instance by a closing body 16 attached to the body 13.

The area or section of the opening 32° of the resonance chamber 32 along the wall 24*b*, is significantly lower than the area or section of the interlacing chamber 24, seen frontally from the side of the nozzle 26, namely in a normal direction to the plane 15, as is clearly shown in FIG. 4.

The function of this resonance chamber 32 is to accentuate the turbulence and efficacy of the air flow and relative whirls which are set up about the yarn Y, in order to produce the interlacing effect, as better described in the following.

Preferably, in association with the semi-spherical shape of the interlacing chamber 24, the resonance chamber 32 is formed, according to a cylindrical shape defined by a diameter Ø2 and for a depth P, in the normal direction to the plane of contact 15 and along an axis passing through the centre of the sphere of radius R defining the wall 24*b*, as is clearly visible from the drawings.

By way of example and with the symbols defined below, the table following sets out the preferred ranges, defined by a minimum value Min and a maximum value Max, and the preferred nominal values Nom, for the dimensions of the fundamental parts constituting the interlacing device 10 and define the shape it will have.

In particular, as discussed in greater depth later on, these numbers refer to the effective dimensions of some prototypes of the interlacing device of the invention, made and thoroughly tested by the Applicant.

| | R [mm] | A [mm] | B [mm] | Ø1 [mm] | P [mm] | Ø2 [mm] |
|---|---|---|---|---|---|---|
| Min | 1.4 | 1.5 | 0.5 | 1.0 | 3 | 0.9 |
| Max | 2.5 | 3.5 | 1.5 | 1.4 | 6 | 1.2 |
| Nom | 2 | 2 | 1.25 | 1.1 | 4.5 | 1.0 |

R radius of the semi-spherical surface that defines the concave wall of the interlacing chamber;
A width of the entrance and exit channels of the interlacing duct;
B height of the entrance and exit channels;
Ø1 diameter of the nozzle for emission of the jet of compressed air;
Ø2 diameter of the resonance chamber associated with the interlacing chamber;
P depth of the resonance chamber.

The parts 12 and 13 are made from materials suited to the operating conditions of the interlacing device 10, in particular with hard materials suitable to tolerate the rubbing action of the yarn, such as for example special resins and ceramic type materials, or even metallic type materials.

Operation of the Interlacing Device of the Invention

In operation, the yarn Y is fed according to known arrangements at a constant speed V to the interlacing device 10, along the relative axis 11, so that the yarn Y continuously traverses the device 10, being guided in its traversing movement by the entrance and exit channels 22 and 23, and also by the wall 12*a* of the first body 12.

At the same time the nozzle 26 is fed with compressed air, at the nominal pressure Pn, by the corresponding plant, so as to continuously emit a continuous jet of air 31 towards the concave wall 24*b*, in a direction substantially perpendicular to the path of the yarn Y through the device 10.

Therefore, the jet of air 31 intersects the yarn Y, as the latter advances at speed V through the interlacing chamber 24, and is also subjected, in the area of the wall 24*b*, to a deflection, guided and controlled by the special concave shape of the wall 24*b*, which acts to direct the main air flow coming from the nozzle 26 backwards, again towards the yarn Y, as indicated by the lines of flow 31*a*.

In this way the jet of compressed air 31 activates, inside the interlacing chamber 24 and around the advancing yarn Y, a highly turbulent flow of air, the whirls of which interact with the yarn Y and are such as to determine the entanglement of its filaments, with the resultant transformation of the structure of the yarn Y from a simple filamentary structure to a more complex and interlaced structure, characterized by knots Y2 in correspondence with which the bonds between the filaments of the yarn Y are concentrated.

The resonance chamber 32, in turn, receives at least a part of the jet of compressed air emitted by the nozzle 31, and in this way cooperates with the interlacing chamber 24, establishing a continuous and rapid exchange of air with the latter-named, so as to accentuate the turbulence of the continuous flow of air which is activated around the yarn Y, in order to produce the effect of entanglement and interlacing between its filaments.

In particular the resonance chamber 32 operates, in association with the interlacing chamber 24, as a kind of fluodynamic resonator, which establishes resonance conditions that amplify the intensity and efficacy of the air whirls inside the chamber 24.

From what has been said it will therefore be clear that the characteristics of turbulence and therefore of efficacy of the air flow activated about the yarn Y, in order to produce the interlacing between its filaments, are conditioned and controlled decisively, possibly with the aid of other factors, by the shape of the interlacing chamber 24, and specifically by the concave shape of the relative second wall 24*b*.

It is also clear that the presence of the resonance chamber 32 contributes to significantly increasing efficacy of the flow and whirls of air that act on the yarn Y to interlace it.

The turbulent flow about the yarn Y is sustained in time by the jet of air that is constantly input into the chamber 24, so that the yarn Y is interlaced continuously as it traverses the device 10.

Experimental Trials

The Applicant has not confined itself to identifying the basic concept of the present invention, but has also effectively put it into practice and experimented it thoroughly.

In particular the Applicant has supported the development and improvement of the invention by producing a series of prototypes that have undergone extensive and in-depth experimentation, and which, inter alia, have served to demonstrate how the interlacing device of the invention permits highly positive results to be obtained, in some aspects exceptional when put in relation to what is obtained with the interlacing devices known today.

In this context, the tests carried out have shown clearly that the interlacing device 10, thanks to the special configuration of the interlacing chamber 24, characterized by the concave wall 24*b* suitable for receiving and deflecting the jet of compressed air 31 emitted by the nozzle 26, and thanks also to the presence of the resonance chamber 32 associated with the interlacing chamber 24, is capable of obtaining a conspicuous saving in the consumption of compressed air, for a like quality of interlaced yarn produced and in particular for a like number of knots per unit of length of yarn interlaced.

For the sake of completeness and by way of example, the data relative to some of these results, obtained with a series of prototypes of the device 10 made in accordance with the dimensional values set out above, are illustrated below in comparison with those of a known device currently on sale.

| Device type | Pressure Pn [bar] | Yarn speed V [m/mm] | Nozzle diam. Ø1 [mm] | Air consumption [$m^3$/hour] | Knots Per metre | R1 (min. number of knots after stretching by 3%) | R2 (min. number of knots after stretching by 6%) |
|---|---|---|---|---|---|---|---|
| Known model already on sale | 4.5 | 750 | 1.6 | 6.5 | 97 ÷ 100 | 97 | 43 |
| Device of the invention | 4.5 | 750 | 1.2 | 3.1 | 102 ÷ 104 | 98 | 45 |

These figures, though summary and partial, clearly show how the interlacing device of the invention is capable, with respect to the technical solutions currently adopted in the industry, of obtaining a significant and effective saving, quantifiable as about 50%, in terms of consumption of compressed air, for like pressure of the jet of compressed air, and of the other key parameters indicating quality of the production of an interlaced yarn, such as the number of knots produced per unit of length of yarn, and the number of knots after a stretching of the interlaced yarn from 3 to 6%.

Therefore, in short, the interlacing device of the invention appears capable of producing an interlaced yarn that fully satisfies all the necessary structural and quality requirements, and also of supporting a production capacity equal to that required by the industry, but at a significantly lower cost in terms of consumption of compressed air than the air interlacing devices currently in use.

Further Embodiments of the Interlacing Device

Naturally, while remaining within the scope of the present invention, other embodiments of the interlacing device are possible, as alternatives to the preferred embodiment described above and constituted by the interlacing device 10.

In particular, as already set out in the preceding description, the concavity of the wall 24*b* that receives the jet of compressed air 31 may be defined by any surface other than a semi-spherical surface, for instance by an elliptical surface or similar.

By way of example, some of these further possible embodiments will be described briefly in the following where, for clarity's sake, the parts of each of these corresponding to those of the interlacing device 10, will be designated using numerical references progressively incremented by multiples of 100, namely 100 for the first further embodiment, 200 for the second further embodiment, 300 for the third, and so on.

Figure 5A:
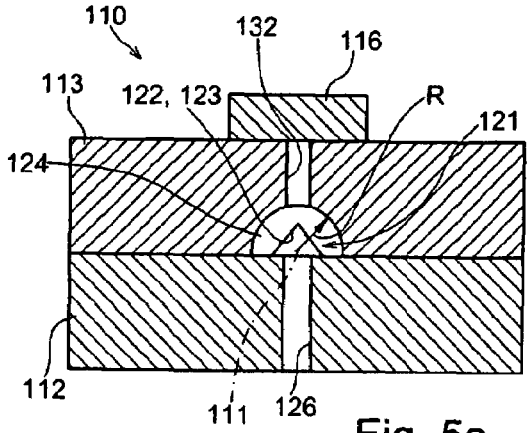
FIGS. 5*a*-5*f* are sections and views of further embodiments of the interlacing device of the invention.

According to a first further embodiment of the interlacing device, designated using the numeral 110 and depicted in section view in FIG. 5*a*, the entrance channel 122 and the exit channel 123, arranged to the sides of the interlacing chamber 124 and made in the second body 113, have a trapezoidal or similar transverse section, rather than rectangular, in the plane normal to the yarn feeding path Y through the device 110.

Figure 5B:
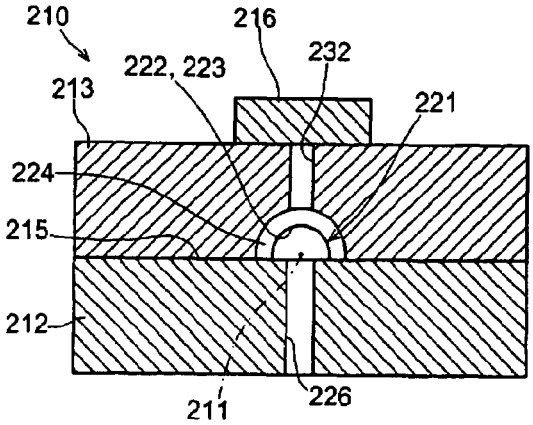

In a second further embodiment, designated using the numeral 210 in FIG. 5*b*, the first entrance channel 222, and the second exit channel 223, for feeding to and respectively receiving the yarn Y from the intermediate interlacing chamber 224, have instead a semicircular section.

Figure 5C:
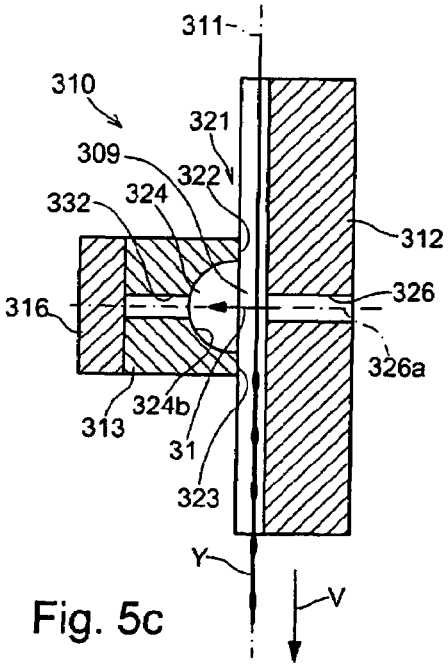
Figure 5D:
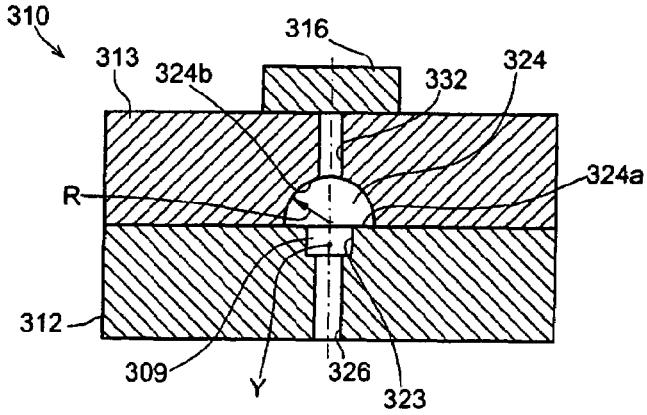

According to a third further embodiment, designated using the numeral 310 and depicted in section view in FIGS. 5*c* and 5*d*, the two channels, entrance 322 and exit 323, are made entirely in the first body 312, instead of in the second body 313 as in the device 10, so that the two channels 322 and 323 accede to the intermediate interlacing chamber 324 without interfering with the relative concave surface 324*b*, made in the second body 313, and the first wall 324*a* in turn has a groove 309 that constitutes the continuation of the two channels 322 and 323 in the zone of the interlacing chamber 324.

Alternatively, the entrance and exit channels of the yarn may be made, over their entire longitudinal extension, partly in the first body and partly in the second body of the interlacing device.

Figure 5E:
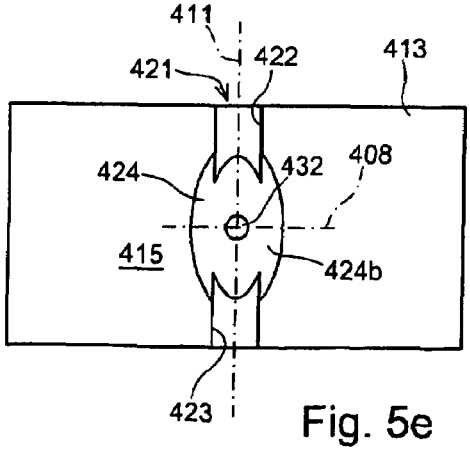
Figure 5F:
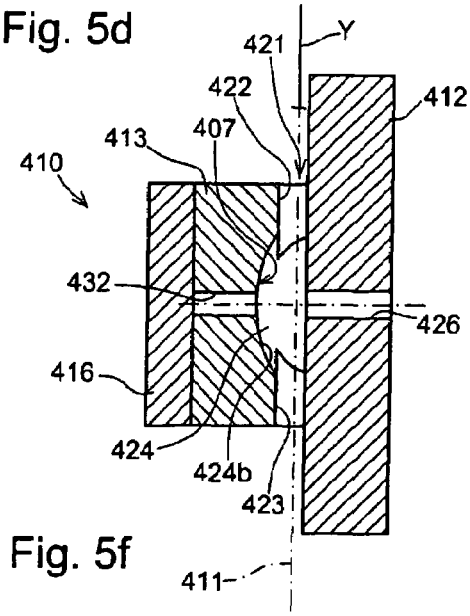

Again, according to a fourth further embodiment, designated using the numeral 410 and depicted in FIGS. 5*e* and 5*f*, the interlacing chamber 424 exhibits frontally, from the side of the first body 412, an elongated shape along an axis of symmetry, selected from either the axis 411 corresponding to the yarn feeding path Y, or the axis 408 normal to the path, and consequently, on account of this elongated shape, the interlacing chamber 424 has a first concavity, on the longitudinal plane containing the path of the yarn, and a second concavity, on the plane transversal to the yarn path, in which these two concavities are geometrically different from one another, and for instance at least one of these is defined in section by a semi-elliptical or similar profile 407, as depicted in FIG. 5*f*.

What is claimed is:

1. Device for air interlacing (10) of a yarn (Y), comprising:

an interlacing duct (21, 22, 23, 24) for the passage and guidance of said yarn through said device (10), said interlacing duct (21) having an interlacing chamber (24), a first entrance channel (22) for receiving the yarn (Y) at the entrance of said device and feeding it to said interlacing chamber (24), and a second exit channel (23) for receiving the yarn from said interlacing chamber (24) and releasing it at the exit of said device, said interlacing chamber being delimited by a first emitting wall (24*a*) bearing a nozzle (26) for the emission of a jet of compressed air (31) inside said interlacing chamber (24), and by a second deflecting wall (24*b*), opposite the first wall (24*a*) and having a concave shape, which is suitable for receiving and deflecting the jet of compressed air (31) emitted by the nozzle (26) and intersecting the yarn to be interlaced, wherein said interlacing chamber (24) has a transverse section, with respect to the feeding path (11) of the yarn (Y) through the device (10) and as defined by the concave shape of said second deflecting wall, which is greater than that of each of said two channels (22, 23).

2. Interlacing device (10) according to claim 1, wherein said second deflecting wall (24*b*) is concave both on a transverse plane and on a longitudinal plane with respect to feeding direction (11) of the yarn (Y) through said device.

3. Interlacing device according to claim 1, wherein said first wall (24*a*) is defined by a flat surface.

4. Device according to claim 1, wherein the concave shape of said second wall (24*b*) is defined by a spherical surface.

5. Device according to claim 4, wherein said spherical surface is constituted by a semi-spherical surface.

6. Device according to claim 5, wherein the radius (R) of said spherical surface is between 1.4 and 2.5 mm.

7. Device according to claim 6, wherein the radius of said spherical surface is approximately 2 mm.

8. Device according to any claim 1, wherein said nozzle (26) is defined by a cylindrical hole having a diameter (Ø1) between 1 and 1.4 mm.

9. Device according to claim 8, wherein said diameter (Ø1) is approximately 1.1 mm.

10. Device according to claim 1, wherein said first and second channels (22, 23) accede to said interlacing chamber (24) by interfering with the respective concave surface (24*b*)

11. Device according to claim 1, wherein at least one (22, 23) of said first and said second channel has a rectangular section.

12. Device according to claim 11, wherein the width (A) of said rectangular section is between 1.5 and 3.5 mm, and the height (B) of said rectangular section is between 0.5 and 1.5 mm, with said second concave wall (24*b*) defined by a semi-spherical surface having a radius (R) between 1.4 and 2.5 mm.

13. Device according to claim 1, wherein it further comprises a resonance chamber (32) in communication with said interlacing chamber (24) and having the function of facilitating, inside the latter, the creation of air whirls responsible for the interlacing effect.

14. Device according to claim 13, wherein said resonance chamber (32) communicates with said interlacing chamber (24) in correspondence with an aperture (32*a*) formed in said second concave wall (24*b*), and wherein said resonance chamber (32) extends from said aperture (32*a*) in a direction substantially in line with the axis (26*a*) of said emission nozzle (26).

15. Device according to claim 13, wherein said resonance chamber (32) is defined by a cylindrical blind hole.

16. Device according to claim 15, wherein the diameter (Ø2) of said cylindrical blind hole is between 0.9 and 1.2 mm and has a depth between 3 and 6 mm.

17. Device according to claim 1, formed by a first (12) and a second body (13), each suitable for being opened with respect to the other, wherein said nozzle (26) for emission of the jet of compressed air is made in said first body (12);

wherein said interlacing duct (21) is made entirely in said second body (13) and further comprises:

said first entrance channel (22) for receiving the yarn (Y) at the entrance of said device and feeding to said interlacing chamber (24), said second exit channel (23) for receiving the yarn from said interlacing chamber (24) and releasing it at the exit of said device; and wherein said first body (12) has a flat surface (15) provided for mating in contact with said second body (13) and defining said first wall (24*a*) of emission of said interlacing chamber (24).

18. Device according to claim 17, wherein said first body (12) also defines a guiding wall (12*a*) for guidance of said yarn (Y) as it traverses said device to be interlaced, said guiding wall (12*a*) extending externally to the zone of said entrance and exit channels (22, 23) and on the same plane (15) as the flat surface corresponding to said first wall (24*a*) of said interlacing chamber (24).

19. Device (310) according to claim 1, made of a first (312) and a second (313) body, each of which may be opened with respect to the other, wherein said nozzle (326) for emission of the jet of compressed air is made in said first body (312) and said interlacing chamber (324) is made in said second body (313);

wherein said interlacing duct (321) further comprises:

said first entrance channel (322) for receiving the yarn (Y) at the entrance of said device and feeding it to said interlacing chamber (324), and said second exit channel (323) for receiving the yarn from said interlacing chamber (24) and releasing it at the exit of said device; and wherein said first (322) and said second (323) channel are carved in said first body (312) and define a groove (308) in the zone of said interlacing chamber (324) in the relative first emitting wall (324*a*).

20. Textile equipment for the processing of one or more yarns comprising at least one air interlacing device according to claim 1.

21. Method for air interlacing of a yarn (Y) comprising:

feeding the yarn (Y) along a respective feeding path (11), intersecting with a jet of compressed air (31) said yarn as it advances, and deflecting said jet of air (31) intersecting said yarn (Y) by means of a first surface (24*b*) arranged, with respect to said yarn, at an end opposite that of emission of said jet of compressed air and having a concave shape (24*b*) on a longitudinal plane and on a transverse plane with respect to the feeding path of said yarn (Y), said first concave surface (24*b*) being associated with a second surface (24*a*) arranged, with respect to said yarn (Y), on the side of emission of said jet of compressed air and suitable for receiving the air deflected by said first concave surface (24*b*) for defining with the latter an interlacing chamber (24) around said yarn (Y) as it advances, wherein said interlacing chamber (24) is dimensioned in such a way to have a transverse section, with respect to the feeding path (11) of the yarn (Y) and as defined by the concave shape of said first surface (24*b*), which is greater than that of each of two channels (22, 23) arranged along the yarn path respectively for feeding the yarn into and from said interlacing chamber (24).

22. Method according to claim 21, wherein said second surface (24*a*), opposite said first concave surface (24*b*), is flat.

23. Method according to claim 21, wherein said first concave surface (24*b*) defines a central axis of symmetry about which said concave shape is formed, and wherein said concave surface is suitable for centrally receiving, on the respective axis of symmetry, said jet of compressed air (31).

24. Method according to claim 23, wherein the central axis of symmetry of the concave surface (24*b*) and the axis of emission (26*a*) of said jet of compressed air (31) substantially coincide and are oriented in a direction substantially perpendicular to said feeding path.

* * * * *